US011820623B2

(12) United States Patent
Maruyama et al.

(10) Patent No.: US 11,820,623 B2
(45) Date of Patent: Nov. 21, 2023

(54) SHEET ALIGNMENT IN SHEET CONVEYING DEVICE

(71) Applicant: TOSHIBA TEC KABUSHIKI KAISHA, Tokyo (JP)

(72) Inventors: Shinji Maruyama, Izunokuni Shizuoka (JP); Mikio Yamamoto, Izunokuni Shizuoka (JP); Naofumi Soga, Sunto Shizuoka (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/466,361

(22) Filed: Sep. 3, 2021

(65) Prior Publication Data

US 2021/0395030 A1 Dec. 23, 2021

Related U.S. Application Data

(63) Continuation of application No. 16/363,484, filed on Mar. 25, 2019, now abandoned.

(51) Int. Cl.

| | |
|---|---|
| ***B65H 9/00*** | (2006.01) |
| ***B65H 5/36*** | (2006.01) |
| ***B65H 5/06*** | (2006.01) |

(52) U.S. Cl.

CPC ..... *B65H 5/36* (2013.01); *B65H 5/062* (2013.01); *B65H 9/00* (2013.01)

(58) Field of Classification Search

CPC . B65H 5/36; B65H 5/062; B65H 9/00; B65H 9/004; B65H 9/006; B65H 9/008

See application file for complete search history.

(56) References Cited

U.S. PATENT DOCUMENTS

| | | | | |
|---|---|---|---|---|
| 4,548,394 A * | 10/1985 | Koyama | B65H 3/44 271/235 |
| 4,936,567 A | 6/1990 | Fukui | |
| 5,022,642 A * | 6/1991 | Hasegawa | B65H 3/5223 271/227 |
| 5,277,415 A | 1/1994 | Kinoshita et al. | |

(Continued)

FOREIGN PATENT DOCUMENTS

JP 2015-165279 A 9/2015

OTHER PUBLICATIONS

Extended European Search Report dated Jun. 9, 2020, mailed in counterpart European Patent Application No. 19209988.5, 9 pages.

*Primary Examiner* — Thomas A Morrison
(74) *Attorney, Agent, or Firm* — Kim & Stewart LLP

(57) ABSTRACT

A sheet conveying device includes an aligning roller and a sheet guide. The aligning roller is configured to rotate in a forward direction along a sheet conveying direction, and stop rotation or rotate in a reverse direction to align a sheet conveyed thereto with a nip formed with the aligning roller. The sheet guide is disposed along a sheet conveyance path extending to the nip in the sheet conveying direction, and movable between a first position at which the sheet conveyance path has a first width in a thickness direction of the sheet and a second position at which the sheet conveyance path has a second width in the thickness direction less than the first width. The sheet guide is at the first position when the aligning roller stops rotation or rotates in the reverse direction and at the second position when the aligning roller rotates in the forward direction.

20 Claims, 8 Drawing Sheets

(56) References Cited

U.S. PATENT DOCUMENTS

| | | | | |
|---|---|---|---|---|
| 5,362,041 | A | 11/1994 | Ryuzaki et al. | |
| 5,933,697 | A * | 8/1999 | Onodera | G03G 15/6564 399/388 |
| 6,602,008 | B2 | 8/2003 | Yamagishi et al. | |
| 6,805,347 | B2 | 10/2004 | Kuramoto | |
| 8,109,507 | B2 | 2/2012 | Okumura et al. | |
| 9,896,291 | B2 | 2/2018 | Sugiyama | |
| 2003/0044217 | A1* | 3/2003 | Matsuda | B65H 5/38 400/579 |
| 2009/0184461 | A1* | 7/2009 | Ishikawa | B65H 5/36 271/254 |
| 2010/0156040 | A1* | 6/2010 | Kobayashi | B65H 9/006 271/226 |
| 2010/0314827 | A1* | 12/2010 | Nishii | G03G 15/6561 271/264 |
| 2016/0060058 | A1* | 3/2016 | Sugiyama | B65H 5/062 271/225 |
| 2019/0092594 | A1* | 3/2019 | Mori | B65H 9/002 |

* cited by examiner

SHEET ALIGNMENT IN SHEET CONVEYING DEVICE

CROSS-REFERENCE TO RELATED APPLICATION

This application is a continuation of U.S. patent application Ser. No. 16/363,484, filed on Mar. 25, 2019, the entire contents of each of which are incorporated herein by reference.

FIELD

Embodiments described herein relate generally to sheet alignment in a sheet conveying device and an image forming system having the same.

BACKGROUND

An image forming system (e.g., an MFP) includes a sheet conveying device that conveys a sheet along a conveying path. The sheet conveying device may include an aligning mechanism that performs alignment processing for correcting a tilt of the sheet conveyed along the conveying path. For example, the aligning mechanism may perform the aligning processing by causing the sheet to hit against a nip of a pair of stopped rollers and bending the sheet. However, if the skew of the sheet is too large during the aligning processing, the sheet may generate wave in a direction different from the sheet conveying direction when the sheet is bent. If the sheet is conveyed by the pair of rollers in a state in which the sheet waves in that manner, sheet damage such as creases and folded traces is likely to occur in the sheet.

DETAILED DESCRIPTION

Figure 1:
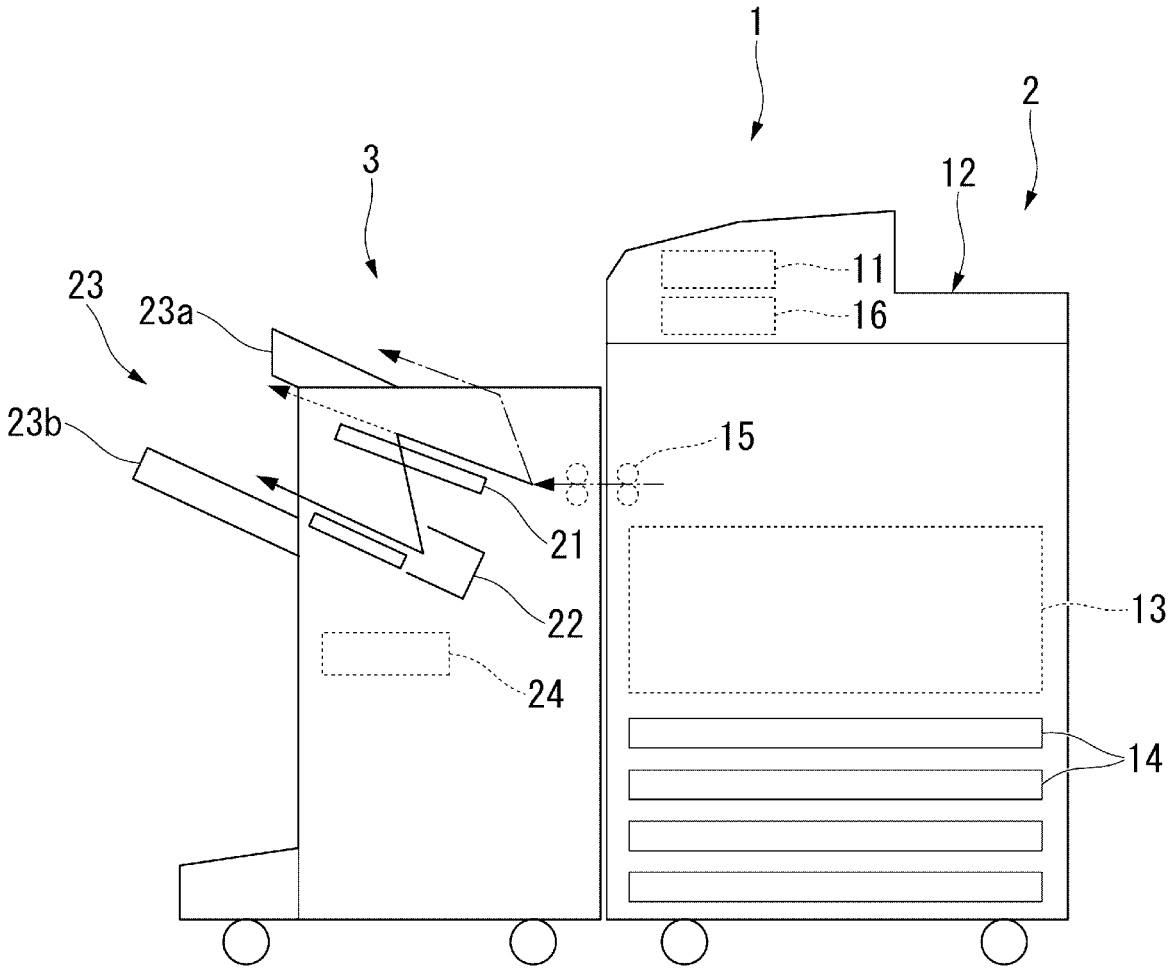
FIG. 1 illustrates a front view of an example of an image forming system according to an embodiment.

In general, according to an embodiment, a sheet conveying device includes an aligning roller and a sheet guide. The aligning roller is configured to rotate in a forward direction along a sheet conveying direction, and stop rotation or rotate in a reverse direction opposite to the forward direction to align a sheet conveyed thereto with a nip formed with the aligning roller. The sheet guide is disposed along a sheet conveyance path extending to the nip in the sheet conveying direction, and movable between a first position at which the sheet conveyance path has a first width in a thickness direction of the sheet and a second position at which the sheet conveyance path has a second width in the thickness direction less than the first width. The sheet guide is at the first position when the aligning roller stops rotation or rotates in the reverse direction for sheet alignment and at the second position when the aligning roller rotates in the forward direction for sheet conveyance.

A sheet conveying device and an image forming system according to an embodiment are described below with reference to the drawings. In the figures, the same components are denoted by the same reference numerals and signs. In the figures, dimensions and shapes of members are exaggerated or simplified for illustrative purpose.

FIG. 1 illustrates a front view of an example of an image forming system 1 according to an embodiment. As illustrated in FIG. 1, the image forming system. 1 includes an image forming apparatus 2 and a post-processing apparatus 3. The image forming apparatus 2 forms an image on a sheet-like medium (hereinafter referred to as "sheet") such as paper. The post-processing apparatus 3 performs post-processing on sheets conveyed from the image forming apparatus 2. The post-processing apparatus 3 is an example of a "sheet processing apparatus".

The image forming apparatus 2 includes a control panel 11, a scanner section 12, a printer section 13, a paper feeding section 14, a paper discharging section 15, and an image-formation control section 16.

The control panel 11 includes various keys for receiving operation of a user. For example, the control panel 11 receives an input to select a type of the post-processing of sheets. The control panel 11 sends information corresponding to the input type of the post-processing to the post-processing apparatus 3.

The scanner section 12 includes a reading section that reads image information of a copying target object. The scanner section 12 sends the read image information to the printer section 13.

The printer section 13 forms an output image (hereinafter referred to as "toner image") with a developer such as toner on the basis of the image information sent from the scanner section 12 or image information transmitted from an external apparatus. The printer section 13 transfers the toner image onto the surface of the sheet. The printer section 13 applies heat and pressure to the toner image transferred onto the sheet to fix the toner image on the sheet.

The paper feeding section 14 supplies sheets to the printer section 13 one by one in accordance with timing when the printer section 13 forms the toner image.

The paper discharging section 15 conveys the sheet discharged from the printer section 13 to the post-processing apparatus 3.

The image-formation control section 16 controls the operation of the entire image forming apparatus 2. That is, the image-formation control section 16 controls the control panel 11, the scanner section 12, the printer section 13, the paper feeding section 14, and the paper discharging section 15. The image-formation control section 16 is formed by a control circuit including a CPU, a ROM, and a RAM.

The post-processing apparatus 3 is explained.

The post-processing apparatus 3 is disposed adjacent to the image forming apparatus 2. The post-processing apparatus 3 executes, on sheets conveyed from the image forming apparatus 2, the post-processing selected through the control panel 11. For example, the post-processing is stapling or sorting. The post-processing apparatus 3 includes a standby section 21, a processing section 22, a discharging section 23, and a post-processing control section 24. In the embodiment, the sheet is conveyed from the image forming apparatus 2 to the discharging section 23.

The standby section 21 temporarily holds up (buffers) the sheet conveyed from the image forming apparatus 2. For example, the standby section 21 puts a following plurality of sheets on standby while the post-processing of preceding sheets is performed by the processing section 22. The standby section 21 is disposed above the processing section 22. If the processing section 22 becomes vacant, the standby section 21 drops the held-up sheet toward the processing section 22.

The processing section 22 performs the post-processing on sheets. For example, the processing section 22 aligns a plurality of sheets. The processing section 22 performs stapling on the aligned plurality of sheets. Consequently, the plurality of sheets are bound. The processing section 22 discharges the post-processed sheets to the discharging section 23.

The discharging section 23 includes a fixed tray 23*a* and a movable tray 23*b*. The fixed tray 23*a* is provided in an upper part of the post-processing apparatus 3. The movable tray 23*b* is provided on a side of the post-processing apparatus 3. Sorted sheets can be discharged to the fixed tray 23*a* and the movable tray 23*b*.

The post-processing control section 24 controls the operation of the entire post-processing apparatus 3. That is, the post-processing control section 24 controls the standby section 21, the processing section 22, and the discharging section 23. The post-processing control section 24 is implemented by a control circuit including a CPU, a ROM, and a RAM.

For example, the post-processing control section 24 controls switching of a processing mode and a non-processing mode (a normal mode). The processing mode means a mode for performing the post-processing on sheets. For example, the processing mode includes a sort mode and a staple mode. The non-processing mode means a mode for directly conveying sheets without performing the post-processing on the sheets.

The control panel 11 includes a mode selecting section (an operation section) (not illustrated in FIG. 1) capable of selecting the processing mode and the non-processing mode. For example, the mode selecting section is a button provided on the control panel 11. The user selects the "processing mode" and presses the button during mode selection, whereby the post-processing control section 24 causes the post-processing apparatus 3 to perform the post-processing on sheets. On the other hand, the user selects the "non-processing mode" and presses the button during the mode selection, whereby the post-processing control section 24 causes the post-processing apparatus 3 to directly discharge the sheets without performing the post-processing on the sheets.

A sheet conveying device is described below in detail.

Figure 2:
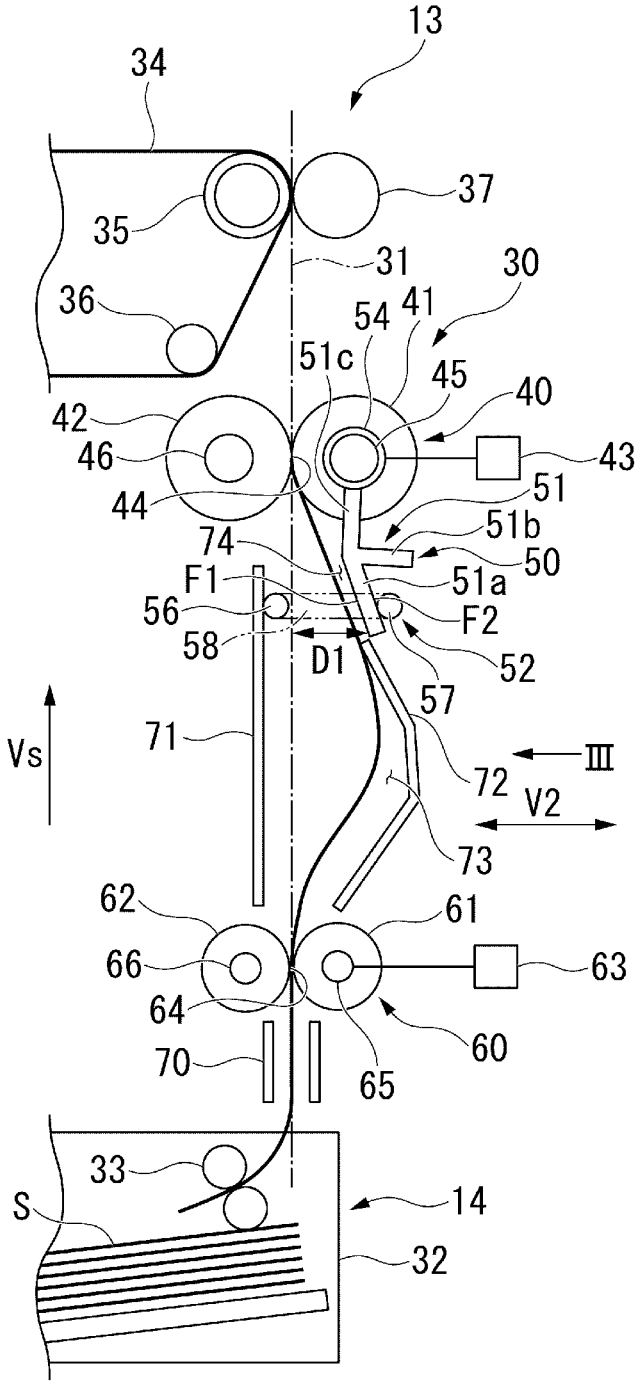
FIG. 2 is a schematic diagram illustrating a main part of a sheet conveying device according to the embodiment.

The image forming system 1 includes a sheet conveying device 30 (see FIG. 2). In the embodiment, the sheet conveying device 30 is provided in the image forming apparatus 2. The sheet conveying device 30 is disposed between the paper feeding section 14 and the printer section 13. The sheet conveying device 30 corrects a tilt of a sheet conveyed from the paper feeding section 14 toward the printer section 13.

FIG. 2 is a schematic diagram illustrating a main part of the sheet conveying device 30 according to the embodiment. FIG. 2 illustrates a state in which a guide 51 distal end portion is in contact with a second restricting convex section 57. As illustrated in FIG. 2, a conveying path 31 is provided inside the image forming apparatus 2 (see FIG. 1). The sheet conveying device 30 includes an aligning mechanism 40, a conveyance-width changing mechanism 50, and a conveying mechanism 60.

First, the conveying path 31 is explained.

The conveying path 31 is provided along a vertical plane. A sheet is conveyed upward along the conveying path 31. The sheet is conveyed from the paper feeding section 14 (e.g., a paper feeding cassette 32) to the printer section 13 (e.g., an image forming section) via the sheet conveying device 30. In the following explanation, the paper feeding section 14 side (the lower side on the paper surface in FIG. 2) in a conveying direction Vs of a sheet (hereinafter referred to as "sheet conveying direction Vs") is referred to as an "upstream side". The printer section 13 side (the upper side on the paper surface in FIG. 2) in the sheet conveying direction Vs is referred to as a downstream side.

In the following explanation, a direction V1 (the depth direction on the paper surface in FIG. 2) orthogonal to the sheet conveying direction Vs in a sheet surface of the sheet conveyed along the conveying path 31 is referred to as "first conveyance orthogonal direction V1". A direction V2 (the left-right direction on the paper surface in FIG. 2) orthogonal to each of the sheet conveying direction Vs and the first conveyance orthogonal direction V1 is referred to as "second conveyance orthogonal direction V2".

As shown in FIG. 2, the sheet conveying device 30 includes a paper feeding cassette 32, a pickup roller 33, an intermediate transfer belt 34, a backup roller 35, a tension roller 36, and a secondary transfer roller 37.

The paper feeding cassette 32 stores sheets S.

The pickup roller 33 extracts the sheet S from the paper feeding cassette 32.

The intermediate transfer belt 34, the backup roller 35, the tension roller 36, and the secondary transfer roller 37 configure the printer section 13.

The backup roller 35 supports the intermediate transfer belt 34.

The secondary transfer roller 37 is opposed to the backup roller 35 via the intermediate transfer belt 34.

The conveying mechanism 60 is explained.

The conveying mechanism 60 is provided in an upstream position of the aligning mechanism 40 in the sheet conveying direction Vs. The conveying mechanism 60 includes a conveying roller pair 61 and 62 and a motor 63 for sheet conveyance.

The conveying roller pair 61 and 62 is disposed close to the pickup roller 33. The conveying roller pair 61 and 62 includes a first conveying roller 61 and a second conveying roller 62 opposed to each other. The first conveying roller 61 is driven by the motor 63 for sheet conveyance. The second conveying roller 62 rotates (is driven to rotate) according to rotation of the first conveying roller 61. The conveying roller pair 61 and 62 conveys a sheet supplied from the pickup roller 33 toward a downstream side of the conveying path 31. The conveying rollers 61 and 62 come into contact with the sheet to thereby convey the sheet when the sheet passes through a nip 44 of an aligning roller pair 41 and 42. The conveying rollers 61 and 62 come into contact with the sheet to thereby convey the sheet when the sheet hits against the nip 44.

As shown in FIG. 2, the sheet conveying device 30 further includes, a conveyance guide wall 70, a linear guide wall 71, and a curved guide wall 72.

The conveyance guide wall 70 forms the conveying path 31 between the pickup roller 33 and the conveying roller pair 61 and 62.

The linear guide wall 71 forms the conveying path 31 between the conveying roller pair 61 and 62 and the aligning roller pair 41 and 42. The linear guide wall 71 linearly extends along the sheet conveying direction Vs.

The curved guide wall 72 forms the conveying path 31 between the curved guide wall 72 and the linear conveyance guide wall 70. The curved guide wall 72 forms a bending space 73 of a sheet in a position close to the conveying roller pair 61 and 62. The curved guide wall 72 curves to project in a direction away from the linear guide wall 71.

Figure 3:
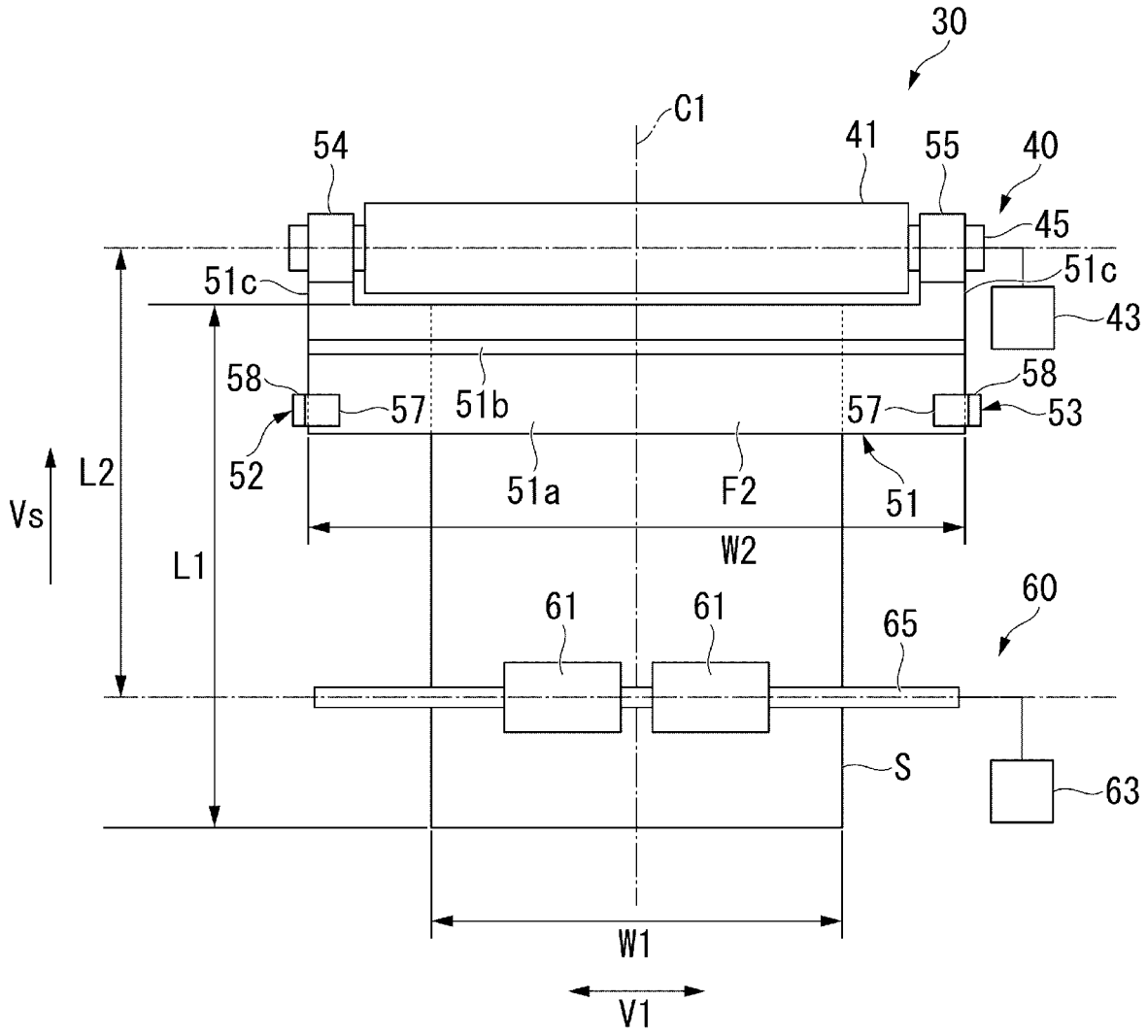
FIG. 3 illustrates a view of the main part of the sheet conveying device from one side in a second conveying orthogonal direction (III arrow in FIG. 2).

FIG. 3 illustrates a view of a main part of the sheet conveying device 30 from one side in the second conveyance orthogonal direction V2 (a III arrow view of FIG. 2). In FIG. 3, the conveyance guide wall 70 and the like is omitted.

As illustrated in FIG. 3, the first conveying roller 61 is fixed to a first conveying shaft 65 (a rotating shaft). Two first conveying rollers 61 are disposed at an interval along the first conveying shaft 65. The two first conveying rollers 61 are disposed across a first conveyance-orthogonal-direction center line C1. The first conveying shaft 65 linearly extends in the first conveyance orthogonal direction V1. The first conveying shaft 65 is longer than a sheet S in the first conveyance orthogonal direction V1. Both end portions of the first conveying shaft 65 is rotatably supported on an image forming apparatus body by a not-illustrated bearing. The first conveying shaft 65 is coupled to the motor for sheet conveyance 63. The motor 63 for sheet conveyance drives to rotate the first conveying shaft 65.

As illustrated in FIG. 2, the second conveying roller 62 is fixed to a second conveying shaft 66 (a rotating shaft) extending in parallel to the first conveying shaft 65. Two second conveying rollers 62 are disposed so as to be opposed to the first conveying rollers 61. Both end portions of the second conveying shaft 66 are rotatably supported on the image forming apparatus body by a not-illustrated bearing.

In FIG. 3, reference sign L1 denotes a length of a sheet in the sheet conveying direction Vs and L2 denotes a sheet conveying path length. The sheet conveying path length L2 denotes a distance between a center axis of the first conveying roller 61 and a center axis of a first aligning roller 41 in the sheet conveying direction Vs. The sheet conveying path length L2 is shorter than the length L1 of the sheet (L2<L1).

The aligning mechanism 40 is explained.

As illustrated in FIG. 2, the aligning mechanism 40 includes an aligning roller pair 41 and 42 and a motor 43 for aligning.

The aligning roller pair 41 and 42 is provided between the conveying roller pair 61 and 62 and the secondary transfer roller 37 (the backup roller 35) in the sheet conveying direction Vs. The aligning roller pair 41 and 42 includes a first aligning roller 41 and a second aligning roller 42 opposed to each other. The first aligning roller 41 and the second aligning roller 42 are in contact with each other to form the nip 44. The aligning mechanism 40 hits a sheet, which is conveyed along the conveying path 31, against the nip 44 to thereby align the position of the leading end of the sheet. The position of the leading end of the sheet means a position at a sheet downstream end in the sheet conveying direction Vs.

The first aligning roller 41 is a driving roller driven by the motor 43 for aligning. The first aligning roller 41 rotates in a forward direction in an arrow R1 direction of FIG. 7) when the sheet passes through the nip 44. The first aligning roller 41 rotates in a reverse direction (in an arrow R2 direction in FIG. 6) opposite to the forward direction when the sheet hits against the nip 44.

The second aligning roller 42 is a driven roller that rotates (is driven to rotate) according to the rotation of the first aligning roller 41. The aligning roller pair 41 and 42 conveys the sheet supplied from the conveying roller pair 61 and 62 toward the downstream side of the conveying path 31.

As illustrated in FIG. 3, the first aligning roller 41 is fixed to a first aligning shaft 45 (a rotating shaft). The first aligning roller 41 extends along the first aligning shaft 45. The first aligning roller 41 has a symmetrical shape with the first conveyance-orthogonal-direction center line C1 as an axis of symmetry. The first aligning shaft 45 linearly extends in the first conveyance orthogonal direction V1. The first aligning roller 41 is longer than the sheet in the first conveyance orthogonal direction V1. The first aligning shaft 45 is longer than the first aligning roller 41 in the first conveyance orthogonal direction V1. Both end portions of the first aligning shaft 45 are rotatably supported on the image forming apparatus body by a not-illustrated bearing. The first aligning shaft 45 is coupled to the motor for aligning 43. The motor for aligning 43 drives to rotate the first aligning shaft 45.

As illustrated in FIG. 2, the second aligning roller 42 is fixed to a second aligning shaft 46 (a rotating shaft) extending in parallel to the first aligning shaft 45. One second aligning roller 42 is disposed so as to be opposed to the first aligning roller 41. Both end portions of the second aligning shaft 46 are rotatably supported on the image forming apparatus body by a not-illustrated bearing.

The conveyance-width changing mechanism 50 is explained.

The conveyance-width changing mechanism 50 is provided in an upstream position of the nip 44 in the sheet conveying direction Vs. In the following explanation, the width of the conveying path 31 near the nip 44 is referred to as "nip vicinity conveyance width". In FIG. 2, the nip vicinity conveyance width is denoted by reference sign D1.

Here, an imaginary straight line (vertical line) passing the conveying roller pair 61 and 62 and the aligning roller pair 41 and 42 is set. The nip vicinity conveyance width is the width of the conveying path 31 near the nip 44 in the second conveyance orthogonal direction V2 and means an interval between the imaginary straight line and the distal end portion of the guide 51. The distal endportion of the guide 51 means an upstream end of the guide 51 in the sheet conveying direction Vs. The conveyance-width changing mechanism 50 sets the nip vicinity conveyance width when the sheet hits against the nip 44 larger than the nip vicinity conveyance width when the sheet passes through the nip 44 after hitting against the nip 44.

The conveyance-width changing mechanism 50 includes a guide 51, position restricting sections 52 and 53, and torque transmitting and interrupting sections 54 and 55 (see FIG. 3).

The guide 51 operates in accordance with the rotation of the first aligning roller 41, which is the driving roller. The guide 51 swings around the first aligning shaft 45. The guide 51 swings coaxially with the first aligning roller 41. A swing center of the guide 51 is coaxial with a rotation center of the first aligning roller 41. The guide 51 defines the nip vicinity conveyance width during reverse rotation of the first aligning roller 41 larger than the nip vicinity conveyance width during forward rotation of the first aligning roller 41.

As illustrated in FIG. 3, the guide 51 is longer than the sheet S in the first conveyance orthogonal direction V1. Length W2 of the guide 51 in the first conveyance orthogonal direction V1 is larger than width W1 of the sheet S in the first conveyance orthogonal direction V1 (W2>W1). The guide 51 includes a guide body 51*a*, a reinforcing rib 51*b*, and coupling pieces 51*c*. The guide body 51*a*, the reinforcing rib 51*b*, and the coupling pieces 51*c* are integrally formed by the same member.

The guide body 51*a* has a plate shape extending in the first conveyance orthogonal direction V1. When viewed from the first conveyance orthogonal direction V1 (see FIG. 2), the guide body 51*a* extends outward (radial direction outward of the first aligning roller 41) from the first aligning shaft 45. Then, the guide body 51*a* bends and extends to separate from the conveying path 31 further outward in the radial direction.

As illustrated in FIG. 2, the reinforcing rib 51*b* projects to the opposite side of the conveying path 31 from a bending section of the guide body 51*a*. As illustrated in FIG. 3, the reinforcing rib 51*b* linearly extends in the first conveyance orthogonal direction V1 over the entire guide body 51*a*.

The coupling pieces 51*c* are respectively provided at end portions of the guide body 51*a*. The coupling pieces 51*c* respectively couple the end portions of the guide body 51*a* and the end portions of the first aligning shaft 45.

The position restricting sections 52 and 53 include a first stopper 52 and a second stopper 53.

The first stopper 52 is capable of coming into contact with a first end portion of the guide 51 in the first conveyance orthogonal direction V1. The second stopper 53 is capable of coming into contact with a second end portion of the guide 51 in the first conveyance orthogonal direction V1. The second end portion of the guide 51 means an end portion on the opposite side of the first end portion of the guide 51 in the first conveyance orthogonal direction V1. The stoppers 52 and 53 are fixed to the image forming apparatus body.

The stoppers 52 and 53 include first restricting convex sections 56, second restricting convex sections 57, and coupling sections 58.

As illustrated in FIG. 2, the first restricting convex section 56 and the second restricting convex section 57 are disposed with an interval from each other in the second conveyance orthogonal direction V2. The coupling section 58 couples the first restricting convex section 56 and the second restricting convex section 57. The coupling section 58 extends in the second conveyance orthogonal direction V2. The coupling section 58 is disposed outside the guide 51 in the first conveyance orthogonal direction V1 (see FIG. 3).

The first restricting convex section 56 is capable of coming into contact with a surface F1 (hereinafter referred to as "first surface F1") of the distal end portion of the guide 51 on the conveying path 31 side. The first restricting convex section 56 defines a terminal end in a swinging direction of the guide 51 during the forward rotation of the first aligning roller 41 (see FIG. 7). The first restricting convex section 56 restricts movement of the guide 51 during the forward rotation of the first aligning roller 41 such that the sheet can pass through the nip 44. When the distal end portion of the guide 51 is in contact with the first restricting convex section 56, the first surface F1 is formed in a linear shape extending to be closer to the linear guide wall 71 further on the downstream side in the sheet conveying direction Vs (see FIG. 7).

The second restricting convex section 57 is capable of coming into contact with a surface F2 (hereinafter referred to as "second surface F2") of the distal end portion of the guide 51 on the opposite side of the conveying path 31. The second restricting convex section 57 defines a terminal end in the swinging direction of the guide 51 during the reverse rotation of the first aligning roller 41. The second restricting convex section 57 restricts movement of the guide 51 during the reverse rotation of the first aligning roller 41 such that a bending space 74 of the sheet can be formed in a position near the nip 44. If the distal end portion of the guide 51 is in contact with the second restricting convex section 57, the second surface F2 is formed in a linear shape extending to be further apart from the linear guide wall 71 further on the downstream side in the sheet conveying direction Vs.

The torque transmitting and interrupting sections 54 and 55 (see FIG. 3) disconnect the guide 51 and the first aligning shaft 45 before an overload is applied to the guide 51 and interrupt torque transmission. The torque transmitting and interrupting sections 54 and 55 interrupt torque transmission if the distal end portion of the guide 51 comes into contact with the first restricting convex section 56 during the forward rotation of the first aligning roller 41. Consequently, the torque transmitting and interrupting sections 54 and 55 retain a contact state of the distal end portion of the guide 51 and the first restricting convex section 56 without applying an overload to the guide 51. The torque transmitting and interrupting sections 54 and 55 interrupt the torque transmission when the distal end portion of the guide 51 comes into contact with the second restricting convex section 57 during the reverse rotation of the first aligning roller 41. Consequently, the torque transmitting and interrupting sections 54 and 55 retain a contact state of the distal end portion of guide 51 and the second restricting convex section 57 without applying an overload to the guide 51.

As illustrated in FIG. 3, the torque transmitting and interrupting sections 54 and 55 include a first torque limiter 54 and a second torque limiter 55. The first torque limiter 54 is provided at a first end portion of the first aligning shaft 45 extending in the first conveyance orthogonal direction V1. The second torque limiter 55 is provided at a second end portion of the first aligning shaft 45. The second end portion of the first aligning shaft 45 means an end portion of the first aligning shaft 45 opposite to the first end portion of the first aligning shaft 45. The torque limiters 54 and 55 are provided between the coupling pieces 51*c* of the guide 51 and the end portions of the first aligning shaft 45.

A bend of a sheet during aligning processing of the sheet is explained. The following explanation is explanation of a comparative example not including the conveyance-width changing mechanism 50 according to the embodiment.

Figure 4B:
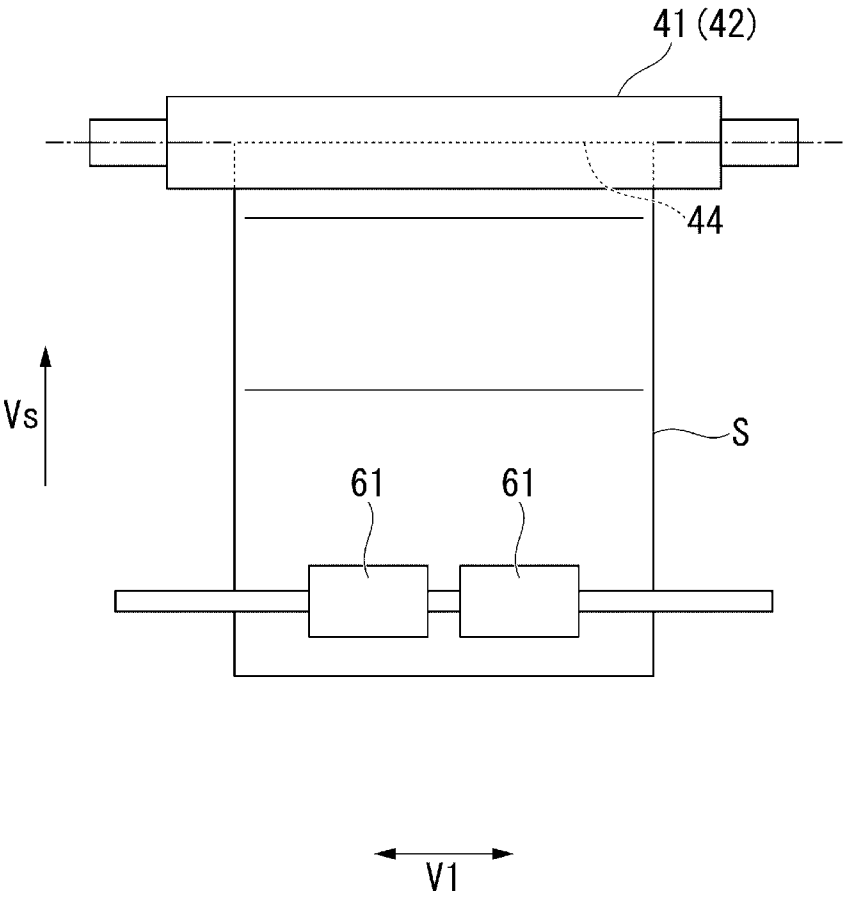
FIGS. 4A and 4B are diagrams to explain a bend of a sheet when the sheet is straightly conveyed in a comparative example.
Figure 4A:
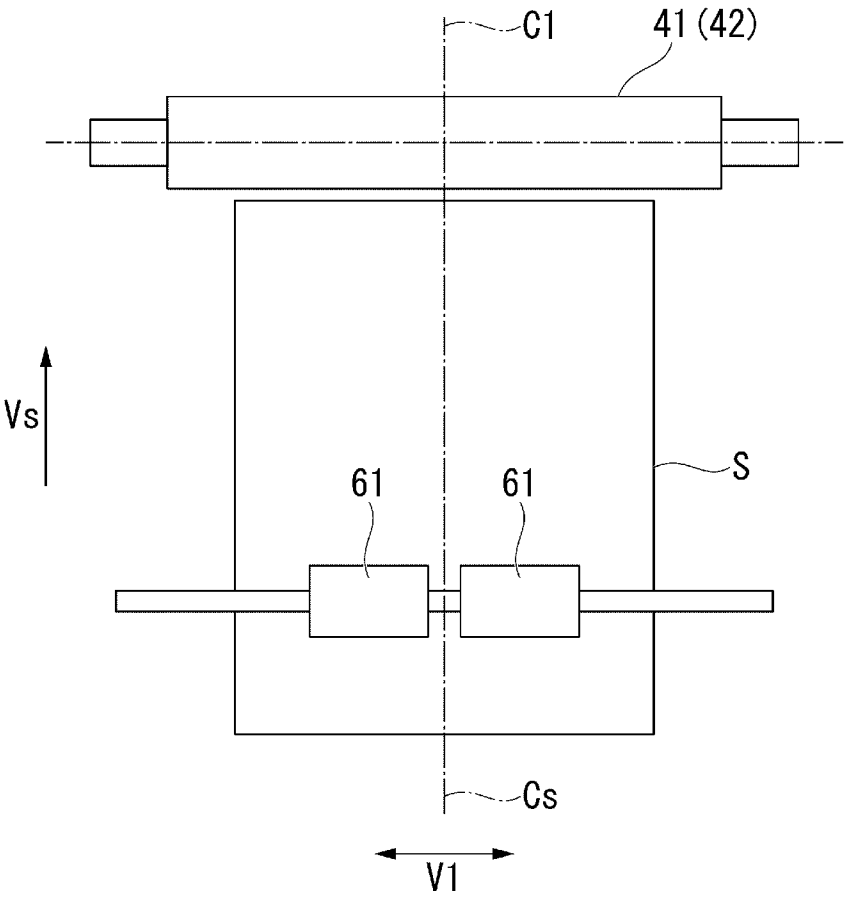

FIGS. 4A and 4B are diagrams to explain a bend of a sheet when the sheet is straightly conveyed in the comparative example. FIG. 4A illustrates a state before the sheet is conveyed into a nip. FIG. 4B illustrates a state in which the sheet hits against the nip and bends.

As illustrated in FIG. 4A, when the sheet S is straightly conveyed, a width direction center line Cs of the sheet S coincides with the first conveyance-orthogonal-direction center line C1.

As illustrated in FIG. 4B, when the sheet S is straightly conveyed, a waving direction of the sheet S is parallel to an extending direction of the aligning roller pair 41 and 42 (the first conveyance orthogonal direction V1). For that reason, even if the sheet S is conveyed into the nip 44 while keeping a waving state, sheet damage such as creases and folded traces is less likely to occur in the sheet S.

Figure 5B:
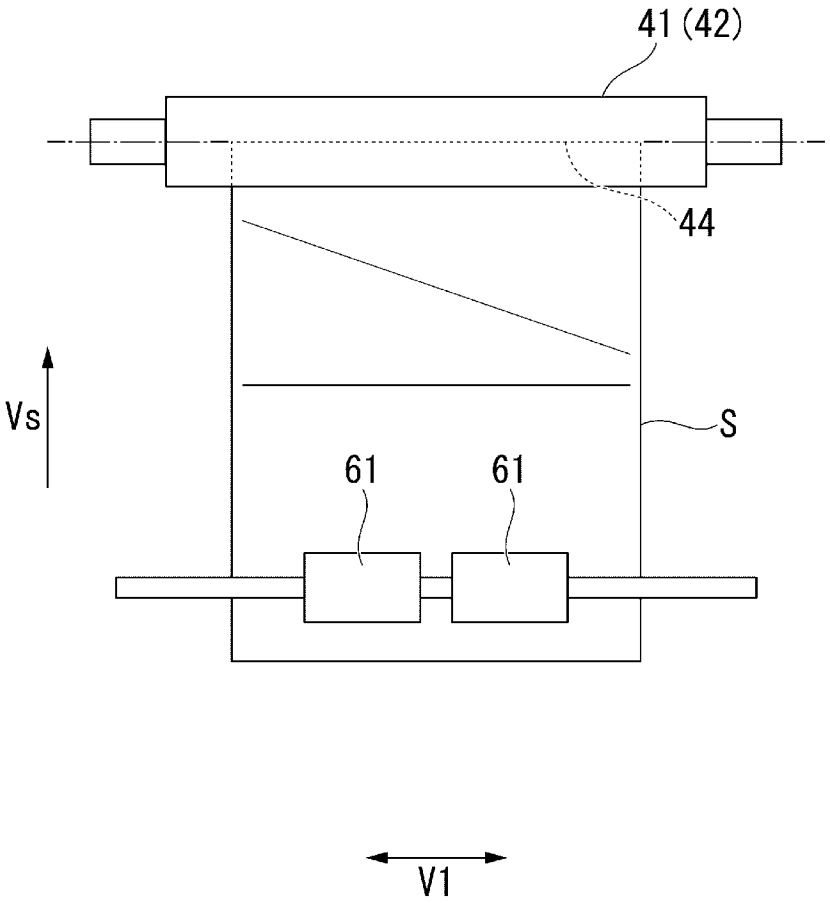
FIGS. 5A and 5B are diagrams to explain a bend of the sheet when the sheet is obliquely tilted and conveyed in the comparative example.
Figure 5A:
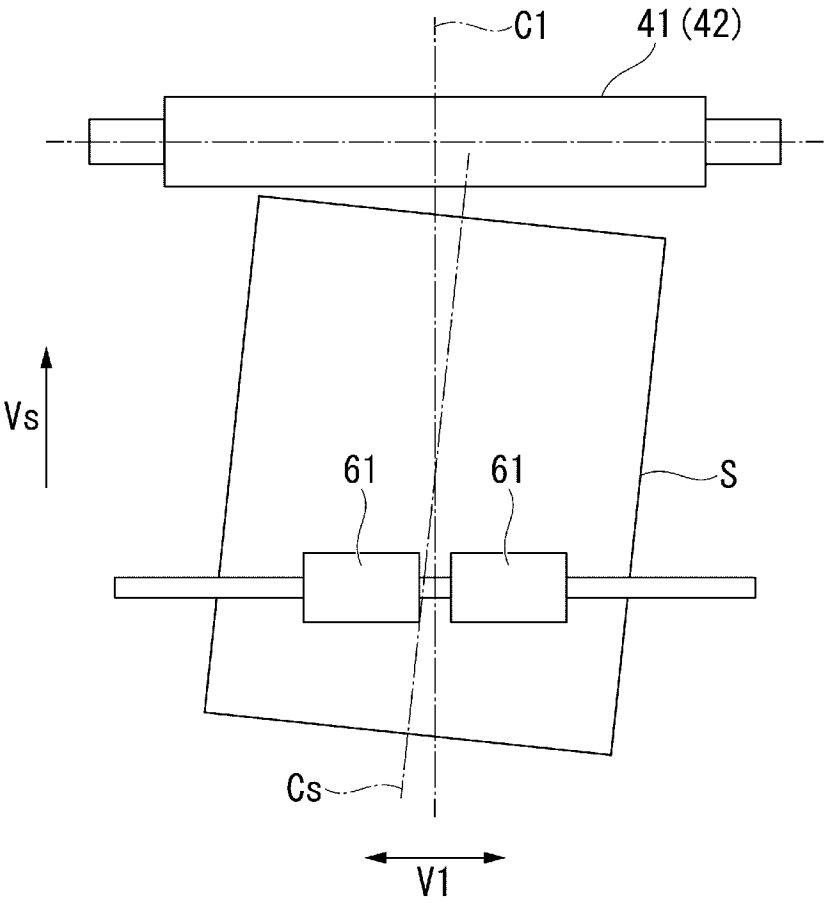

FIGS. 5A and 5B are diagrams to explain a bend of the sheet when the sheet is obliquely tilted and conveyed in the comparative example. FIG. 5A illustrates a state before the sheet is conveyed into the nip. FIG. 5B illustrates a state in which the sheet hits against the nip and bends.

As illustrated in FIG. 5A, when the sheet S is obliquely tilted and conveyed, the width direction center line Cs of the sheet S crosses the first conveyance-orthogonal-direction center line C1.

As illustrated in FIG. 5B, when the sheet S is obliquely tilted and conveyed, a waving direction of the sheet S crosses the extending direction of the aligning roller pair 41 and 42 (the first conveyance orthogonal direction V1). For that reason, if the sheet S is conveyed into the nip 44 while keeping a waving state, sheet damage such as creases and folded traces is more likely to occur in the sheet S.

An example of a sheet aligning operation according to an embodiment is explained.

Figure 6:
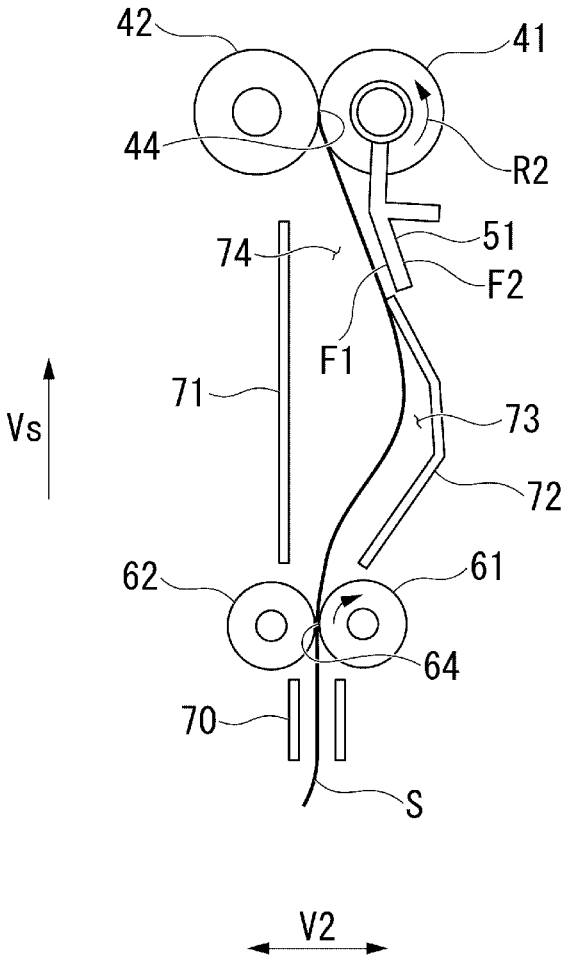
FIG. 6 is a diagram to explain a sheet aligning operation according to an embodiment.

FIG. 6 is a diagram to explain a sheet aligning operation according to an embodiment. In FIG. 6, the position restricting sections 52 and 53 are omitted.

As illustrated in FIG. 6, if the first aligning roller 41 reversely rotates (rotates in the arrow R2 direction), the guide 51 swings in a direction away from the linear guide wall 71 in accordance with the reverse rotation of the first aligning roller 41. Then, a second surface F2 of the distal end portion of the guide 51 comes into contact with the second restricting convex section 57 (see FIG. 2). Consequently, the bending space 74 of the sheet S is formed between the first surface F1 of the guide 51 distal end portion and the linear guide wall 71. That is, the bending space 74 of the sheet S sufficient for tilt correction of the sheet S is secured near the nip 44. The guide 51 defines the nip vicinity conveyance width during the reverse rotation of the first aligning roller 41 to be larger than the nip vicinity conveyance width during the forward rotation of the first aligning roller 41.

When the first conveying roller 61 rotates in a reverse direction, the sheet S hits against the nip 44. If the sheet S hits against the nip 44, the sheet S bends along the first surface F1 of the distal endportion of the guide 51. Thereafter, the sheet S bends in the space 73 between the linear guide wall 71 and the curved guide wall 72. A bend shape of the sheet S is illustrated in FIG. 6. When viewed from the first conveyance orthogonal direction V1, the sheet S extends to be further apart from the linear guide wall 71 further on the downstream side in the sheet conveying direction Vs from the nip 44. Thereafter, the sheet S extends downward passing the downstream end of the curved guide wall 72. Thereafter, the sheet S is spaced apart from the curved guide wall 72, extends to be closer to a forming section of the linear conveying path 31 further on the downstream side in the sheet conveying direction Vs, and reaches a nip 64 of the conveying roller pair 61 and 62.

The second face F2 of the distal end portion of the guide 51 comes into contact with the second restricting convex section 57 (see FIG. 2) in this way, whereby the bending space 74 of the sheet S sufficient for tilt correction of the sheet S is secured near the nip 44. For that reason, even if the sheet S is obliquely tilted and conveyed, the tilt of the sheet S can be sufficiently corrected.

An example of a sheet conveying operation according to an embodiment is explained.

Figure 7:
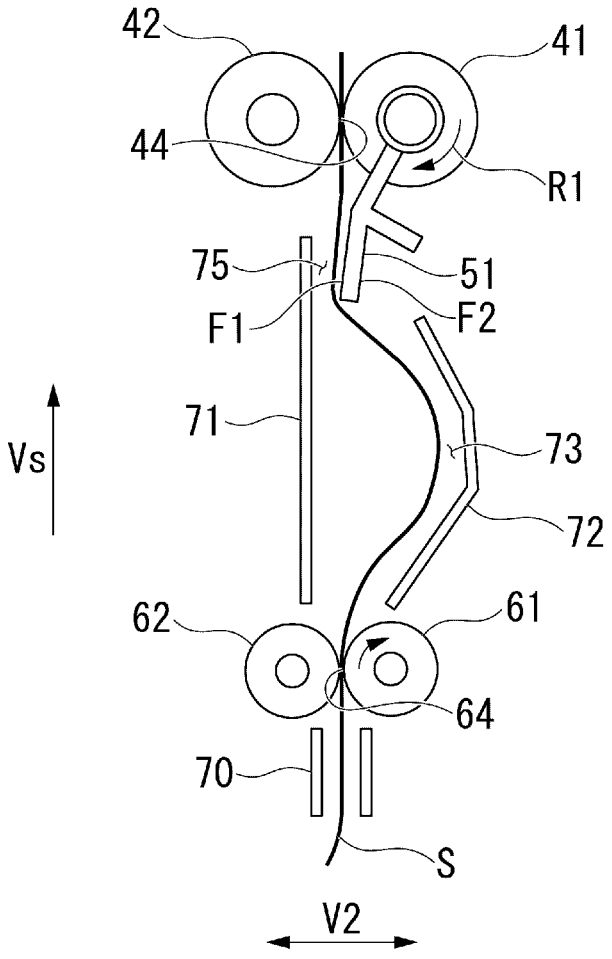
FIG. 7 is a diagram to explain a sheet conveying operation according to an embodiment.

FIG. 7 is a diagram to explain the sheet conveying operation according to an embodiment. In FIG. 7, the position restricting sections 52 and 53 are omitted.

As illustrated in FIG. 7, after the aligning operation on the sheet S, the first aligning roller 41 rotates in the forward direction (the arrow R1 direction). If the first aligning roller 41 rotates in the forward direction, the guide 51 swings in a direction in which the guide 51 approaches the linear guide wall 71 in association with the forward rotation of the first aligning roller 41. Then, the first surface F1 of the guide 51 distal end portion comes into contact with the first restricting convex section 56 (see FIG. 2). Consequently, a bending space of the sheet S is not formed but a space 75 capable of allowing the sheet S to pass is formed between the first surface F1 of the distal end portion of the guide 51 and the linear guide wall 71. That is, the bending space 74 (see FIG. 6) of the sheet S sufficient for the tilt correction of the sheet S is not secured near the nip 44.

The first conveying roller 61 maintains the forward rotation during the conveying operation of the sheet S. When the first conveying roller 61 rotates in the forward direction and the first aligning roller 41 rotates in the forward direction, the sheet S passes through the nip 44. If the sheet S passes through the nip 44, the sheet S bends in the space 73 further on the downstream side than the distal end portion of the guide 51. That is, the sheet S bends in the space 73 between the linear guide wall 71 and the curved guide wall 72. A bend shape of the sheet S is illustrated in FIG. 7. When viewed from the first conveyance orthogonal direction V1, the sheet S linearly extends from the nip 44 along the first surface F1. Thereafter, the sheet S is spaced apart from the curved guide wall 72 and extends from the distal end portion of the guide 51 to be further apart from the linear guide wall 71 further on the downstream side in the sheet conveying direction Vs. Thereafter, the sheet S is spaced apart from the curved guide wall 72 and extends to be further apart from the linear guide wall 71 further on the downstream side in the sheet conveying direction Vs from the distal end portion of the guide 51. Thereafter, the sheet S is spaced apart from the curved guide wall 72, extends to be closer to the forming section of the linear conveying path 31 further on the downstream side in the sheet conveying direction Vs, and reaches the nip 64 of the conveying roller pair 61 and 62.

The first surface F1 of the distal end portion of the guide 51 comes into contact with the first restricting convex section 56 (see FIG. 2), whereby the space 75 capable of allowing the sheet S to pass is formed between the first surface F1 of the distal end portion of the guide 51 and the linear guide wall 71. A bending space of the sheet S sufficient for the tilt correction of the sheet S is not secured near the nip 44. The bending space 73 of the sheet S is secured in a position further on the downstream side than the distal end portion of the guide 51. During the sheet conveying operation after completion of the aligning operation, the guide 51 is projected toward the linear guide wall 71, whereby the guide 51 acts to stretch the sheet S immediately before the sheet S enters the nip 44. For that reason, waving of the sheet S can be suppressed near the nip 44. The sheet S is conveyed in a state in which the sheet S is held on the first surface F1 of the guide 51. Consequently, the sheet S is less likely to wave when passing through the nip 44. Sheet damage such as creases and folded traces less easily occurs in the sheet S.

According to the embodiment, the sheet conveying device 30 includes the aligning mechanism 40 and the conveyance-width changing mechanism 50. The aligning mechanism 40 hits the sheet, which is conveyed along the conveying path 31, against the nip 44 to thereby align the position of the distal end of the sheet. The conveyance-width changing mechanism 50 is provided in the upstream position of the nip 44 in the sheet conveying direction Vs. The conveyance-width changing mechanism 50 defines the nip vicinity conveyance width when the sheet hits against the nip 44 to be larger than the nip vicinity conveyance width when the sheet passes through the nip 44 after hitting against the nip 44. The following effect is achieved by the configuration explained above. When the sheet hits against the nip 44, the bending space 74 of the sheet sufficient for the tilt correction of the sheet can be secured near the nip 44. For that reason, by hitting the sheet against the nip 44, it is possible to sufficiently bend the sheet and align the position of the distal end of the sheet. On the other hand, when the sheet passes through the nip 44, the guide 51 acts to stretch the sheets immediately before the sheet enters the nip 44. For that reason, it is possible to prevent waving of the sheet near the nip 44 and cause the sheet to pass through the nip 44 without waving. Therefore, it is possible to prevent sheet damage such as creases and folded traces from occurring in the sheet.

The aligning mechanism 40 includes the first aligning roller 41, which is the driving roller. The first aligning roller 41 reversely rotates when the sheet hits against the nip 44. The first aligning roller 41 rotates in the forward direction when the sheet passes through the nip 44. With the configuration explained above, the following effect is achieved. It is possible to prevent sheet damage such as creases and folded traces in the sheet with a simple configuration in which the reverse rotation and the forward rotation of the first aligning roller 41 are used.

The conveyance-width changing mechanism 50 includes the guide 51 that operates in accordance with the rotation of the first aligning roller 41. The guide 51 defines the nip vicinity conveyance width during the reverse rotation of the first aligning roller 41 to be larger than the nip vicinity conveyance width during the forward rotation of the first aligning roller 41. With the configuration explained above, the following effect is achieved. An apparatus configuration can be simplified compared with when the guide 51 is operated individually and independently from the rotation of the first aligning roller 41.

In addition, the guide 51 swings coaxially with the first aligning roller 41. According to this configuration, the following effect can be achieved. The apparatus configuration can be simplified compared with when the guide 51 is swung around an axis different from the axis of the first aligning roller 41.

The guide 51 is formed longer than the sheet along the first conveyance orthogonal direction V1. According to this configuration, the following effect can be achieved. Compared with when the guide 51 is formed to be equal to or shorter than the sheet along the first conveyance orthogonal direction V1, even if the sheet is obliquely tilted and conveyed, the sheet is more likely to be held by the guide 51 over the entire sheet in the first conveyance orthogonal direction V1. Therefore, it is possible to more effectively prevent waving of the sheet and more effectively prevent sheet damage such as creases and folded traces.

The conveyance-width changing mechanism 50 includes the position restricting sections 52 and 53 that restrict the position of the guide 51 during the forward rotation and during the reverse rotation of the first aligning roller 41. According to this configuration, the following effect can be achieved. The nip vicinity conveyance width can be set to specific widths when the sheet hits against the nip 44 and when the sheet passes through the nip 44. That is, the nip vicinity conveyance width can be more stable between when the sheet hits against the nip 44 and when the sheet passes through the nip 44. Therefore, it is possible to prevent fluctuation in a correction degree of waving of the sheet and more effectively prevent sheet damage such as creases and folded traces.

The position restricting sections 52 and 53 include the first stopper 52 and the second stopper 53. The first stopper 52 is capable of coming into contact with the first end portion of the guide 51 in the first conveyance orthogonal direction V1. The second stopper 53 is capable of coming into contact with the second end portion of the guide 51 in the first conveyance orthogonal direction V1. With the configuration explained above, the following effect is achieved. Compared with when the position restricting sections 52 and 53 include stoppers capable of coming into contact with only one end portion of the guide 51 in the first conveyance orthogonal direction V1, it is possible to stably hold the guide 51 with each of the first stopper 52 and the second stopper 53. That is the nip vicinity conveyance width in the first conveyance orthogonal direction V1 can be more stable. Therefore, it is possible to prevent fluctuation in a correction degree of waving of the sheet and more effectively prevent sheet damage such as creases and folded traces.

The sheet conveying device 30 further includes the first conveying roller 61 provided in the upstream position of the aligning mechanism 40 in the sheet conveying direction Vs. The first conveying roller 61 conveys the sheet respectively when the sheet passes through the nip 44 and when the sheet hits against the nip 44. With the configuration explained above, the following effect is achieved. With a simple configuration that uses the rotation of the first conveying roller 61, it is possible to prevent sheet damage such as creases and folded traces.

The conveying path 31 is provided along the vertical plane. According to this configuration, the following effect can be achieved. In the sheet conveying device 30 including the conveying path 31 provided along the vertical plane, it is possible to prevent sheet damage such as creases and folded traces.

Modifications are explained below.

The conveying path 31 may not be provided along the vertical plane.

Figure 8:
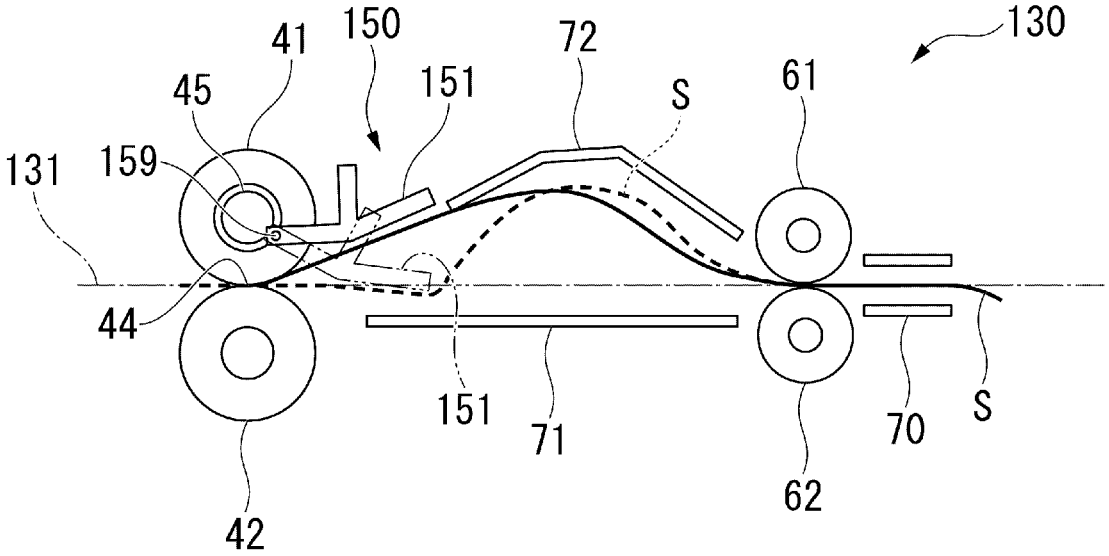
FIG. 8 is a schematic diagram illustrating a main part of a sheet conveying device according to a modification of the embodiment.

FIG. 8 is a schematic diagram illustrating a main part of a sheet conveying device 130 according to a modification of the embodiment.

As illustrated in FIG. 8, a conveying path 131 may be provided along the horizontal plane. A conveyance-width changing mechanism 150 may include a guide 151 provided above the conveying path 131. The conveyance-width changing mechanism 150 may include a support shaft 159 that swingably supports the guide 151. The guide 151 may swing around the support shaft 159, which is a shaft different from the first aligning roller 41 (the first aligning shaft 45).

According to this modification, when the sheet hits against the nip 44, the guide 151 is lifted by the bent sheet S (a solid line). For that reason, it is possible to sufficiently bend the sheet S near the nip 44 and align the position of the distal end of the sheet S. On the other hand, when the sheet S passes through the nip 44, the guide 151 presses down the sheet S (a broken line) with the gravity (own weight). For that reason, it is possible to prevent waving of the sheet S near the nip 44 and cause the sheet S to pass through the nip 44 without waving. Therefore, it is possible to prevent sheet damage such as creases and folded traces.

Another modification of the embodiment is explained.

The sheet conveying device 30 may not be disposed between the paper feeding section 14 and the printer section 13. For example, the sheet conveying device 30 may be disposed near a part where the sheet is reversed. The sheet conveying device 30 may be provided any applicable positions in the conveying path of the image forming system (the image forming apparatus and the post-processing apparatus).

The guide 51 may not operate in accordance with the rotation of the first aligning roller 41. For example, the guide 51 may operate individually and independently from the rotation of the first aligning roller 41. For example, the sheet conveying device 30 may include a control section that controls the operation of the guide 51.

The guide 51 may not swing. The guide 51 may advance and retract. For example, the guide 51 may operate to define the nip vicinity conveyance width during the reverse rotation of the first aligning roller 41 to be larger than the nip vicinity conveyance width during the forward rotation of the first aligning roller 41.

The first aligning roller 41 may not reversely rotate when the sheet hits against the nip 44. For example, the first aligning roller 41 may stop when the sheet hits against the nip 44. For example, the first aligning roller 41 may reversely rotate the sheet after the sheet passes through the nip 44. For example, the sheet conveying device 30 may include a control section that controls the rotation of the first aligning roller 41.

The aligning mechanism 40 may not include the aligning roller pair 41 and 42. For example, the aligning mechanism 40 may include an aligning roller and a pad (a roller contact member). For example, the aligning mechanism 40 may include at least one rotating body.

The conveying mechanism 60 may not include the conveying roller pair 61 and 62. For example, the conveying mechanism 60 may include a conveying roller and a pad (a roller contact member). The conveying mechanism 60 may include at least one rotating body.

The guide 51 may not be longer than the sheet in the first conveyance orthogonal direction V1. For example, the guide 51 may have a length equal to or shorter than the sheet in the first conveyance orthogonal direction V1. For example, a plurality of guides 51 may be disposed at an interval in the first conveyance orthogonal direction V1. For example, on a plate extending in the first conveyance orthogonal direction V1, a plurality of ribs functioning as the guides 51 may be provided with an interval in an extending direction of the plate. The number of the disposed guides 51 and disposition positions of the guides 51 may be changed according to requested specifications.

The disposed aligning roller may not be one. Two or more aligning rollers may be disposed. The number of disposed aligning rollers and disposition positions of the aligning rollers may be changed according to requested specifications.

The disposed conveying rollers are not limited to two. One or three or more conveying rollers may be disposed. The number of disposed conveying rollers and disposition positions of the conveying rollers may be changed according to requested specifications.

According to the at least one embodiment explained above, the sheet conveying device 30 includes the aligning mechanism 40 and the conveyance-width changing mechanism 50. The aligning mechanism 40 causes the sheet, which is conveyed along the conveying path 31, to hit against the nip 44 to thereby align the position of the distal end of the sheet. The conveyance-width changing mechanism 50 is provided in the upstream position of the nip 44 in the sheet conveying direction Vs. The conveyance-width changing mechanism 50 defines the nip vicinity conveyance width when the sheet hits against the nip 44 to be larger than the nip vicinity conveyance width when the sheet passes through the nip 44 after hitting against the nip 44. According to the configuration explained above, the following effect can be achieved. When the sheet hits against the nip 44, it is possible to secure the bending space 74 of the sheet sufficient for the tilt correction of the sheet near the nip 44. For that reason, it is possible to sufficiently bend the sheet by the sheet hitting against the nip 44 and align the position of the distal end of the sheet. On the other hand, when the sheet passes through the nip 44, the guide 51 acts to stretch the sheets immediately before the sheets enter the nip 44. For that reason, it is possible to prevent waving of the sheet near the nip 44 and cause the sheet to pass through the nip 44 without waving. Therefore, it is possible to prevent sheet damage such as creases and folded traces.

While certain embodiments have been described these embodiments have been presented by way of example only, and are not intended to limit the scope of the inventions. Indeed, the novel embodiments described herein may be embodied in a variety of other forms: furthermore various omissions, substitutions and changes in the form of the embodiments described herein may be made without departing from the spirit of the inventions. The accompanying claims and their equivalents are intended to cover such forms or modifications as would fall within the scope and spirit of the invention.

What is claimed is:

1. A sheet conveying device comprising:

a conveying roller configured to convey a sheet;

an aligning roller configured to rotate in a forward direction along a sheet conveying direction for sheet conveyance, and stop rotation or rotate in a reverse direction opposite to the forward direction to align the sheet conveyed by the conveying roller to a nip formed with the aligning roller;

a first stationary sheet guide disposed upstream with respect to the conveying roller in the sheet conveying direction;

a second stationary sheet guide disposed between the conveying roller and the aligning roller along a sheet conveyance path and having a flat surface along the sheet conveyance path;

a third stationary sheet guide facing the second stationary sheet guide and having a curved surface protruding away from the sheet conveyance path;

a movable sheet guide disposed downstream with respect to the third stationary sheet guide along the sheet conveyance path, and swingable between a first position at which the sheet conveyance path has a first width in a thickness direction of the sheet and a second position at which the sheet conveyance path has a second width in the thickness direction less than the first width;

a first stopper positioned to restrict movement of the movable sheet guide further than the first position; and a second stopper positioned to restrict movement of the movable sheet guide further than the second position, wherein the movable sheet guide is attached to the aligning roller, and swings to the first position in accordance with rotation of the aligning roller in the reverse direction and to the second position in accordance with rotation of the aligning roller in the forward direction, the movable sheet guide configured to swing coaxially with the aligning roller rotating in the forward and reverse directions.

2. The sheet conveying device according to claim 1, wherein the aligning roller stops rotation or rotates in the reverse direction to align the sheet conveyed by the conveying roller, and then rotates in the forward direction for the sheet conveyance.

3. The sheet conveying device according to claim 2, wherein when the aligning roller stops rotation or rotates in the reverse direction to align the sheet conveyed by the conveying roller, the sheet conveyed by the conveying roller is warped towards the third stationary sheet guide, and when the aligning roller rotates in the forward direction for the sheet conveyance thereafter, the warped sheet is pushed by the movable sheet guide towards the second stationary sheet guide.

4. The sheet conveying device according to claim 1, wherein the movable sheet guide at the second position is substantially flush with the third stationary sheet guide.

5. The sheet conveying device according to claim 1, further comprising:

a torque limiter configured to disconnect torque transmission of rotation of the aligning roller to the movable sheet guide when the movable sheet guide contacts the first stopper and when the movable sheet guide contacts the second stopper.

6. The sheet conveying device according to claim 1, wherein the movable sheet guide is movable independently of rotation of the aligning roller.

7. The sheet conveying device according to claim 1, wherein the sheet conveyance path extends along a gravity direction.

8. The sheet conveying device according to claim 1, wherein the sheet conveyance path extends along a horizontal direction and the movable sheet guide is disposed above the sheet conveyance path.

9. The sheet conveying device according to claim 1, wherein the movable sheet guide is directly attached to a shaft of the aligning roller, and swings together with the shaft of the aligning roller rotating in the forward and reverse directions.

10. An image forming apparatus comprising:

a printer; and a sheet conveying device configured to convey a sheet to or from the printer, the sheet conveying device comprising:

a conveying roller configured to convey the sheet;

an aligning roller configured to rotate in a forward direction along a sheet conveying direction for sheet conveyance, and stop rotation or rotate in a reverse direction opposite to the forward direction to align the sheet conveyed by the conveying roller to a nip formed with the aligning roller;

a first stationary sheet guide disposed upstream with respect to the conveying roller in the sheet conveying direction;

a second stationary sheet guide disposed between the conveying roller and the aligning roller along a sheet conveyance path and having a flat surface along the sheet conveyance path;

a third stationary sheet guide facing the second stationary sheet guide and having a curved surface protruding away from the sheet conveyance path;

a movable sheet guide disposed downstream with respect to the third stationary sheet guide along the sheet conveyance path, and swingable between a first position at which the sheet conveyance path has a first width in a thickness direction of the sheet and a second position at which the sheet conveyance path has a second width in the thickness direction less than the first width;

a first stopper positioned to restrict movement of the movable sheet guide further than the first position; and a second stopper positioned to restrict movement of the movable sheet guide further than the second position, wherein the movable sheet guide is attached to the aligning roller, and swings to the first position in accordance with rotation of the aligning roller in the reverse direction and to the second position in accordance with rotation of the aligning roller in the forward direction, the movable sheet guide configured to swing coaxially with the aligning roller rotating in the forward and reverse directions.

11. The image forming apparatus according to claim 10, wherein the sheet conveying device is configured to convey the sheet to the printer.

12. The image forming apparatus according to claim 10, wherein the sheet conveying device is configured to convey the sheet from the printer.

13. The image forming apparatus according to claim 10, wherein the aligning roller stops rotation or rotates in the reverse direction to align the sheet conveyed by the conveying roller, and then rotates in the forward direction for the sheet conveyance.

14. The image forming apparatus according to claim 13, wherein when the aligning roller stops rotation or rotates in the reverse direction to align the sheet conveyed by the conveying roller, the sheet conveyed by the conveying roller is warped towards the third stationary sheet guide, and when the aligning roller rotates in the forward direction for the sheet conveyance thereafter, the warped sheet is pushed by the movable sheet guide towards the second stationary sheet guide.

15. The image forming apparatus according to claim 10, wherein the movable sheet guide is directly attached to a shaft of the aligning roller, and swings together with the shaft of the aligning roller rotating in the forward and reverse directions.

16. A sheet processing apparatus comprising:

a sheet processing device configured to process a printed sheet conveyed from a printer; and a sheet conveying device configured to convey a sheet to or from the sheet processing device, the sheet conveying device comprising:

a conveying roller configured to convey the sheet;

an aligning roller configured to rotate in a forward direction along a sheet conveying direction for sheet conveyance, and stop rotation or rotate in a reverse direction opposite to the forward direction to align the sheet conveyed by the conveying roller to a nip formed with the aligning roller;

a first stationary sheet guide disposed upstream with respect to the conveying roller in the sheet conveying direction;

a second stationary sheet guide disposed between the conveying roller and the aligning roller along a sheet conveyance path and having a flat surface along the sheet conveyance path;

a third stationary sheet guide facing the second stationary sheet guide and having a curved surface protruding away from the sheet conveyance path; and a movable sheet guide disposed downstream with respect to the third stationary sheet guide along the sheet conveyance path, and swingable between a first position at which the sheet conveyance path has a first width in a thickness direction of the sheet and a second position at which the sheet conveyance path has a second width in the thickness direction less than the first width, wherein the movable sheet guide is at the first position when the aligning roller stops rotation or rotates in the reverse direction, and at the second position when the aligning roller rotates in the forward direction, the movable sheet guide is attached to the aligning roller, and swings to the first position in accordance with rotation of the aligning roller in the reverse direction and to the second position in accordance with rotation of the aligning roller in the forward direction, the movable sheet guide configured to swing coaxially with the aligning roller rotating in the forward and reverse directions, and the sheet conveying device is configured to convey the sheet from the sheet processing device.

17. The sheet processing apparatus according to claim 16, wherein the aligning roller stops rotation or rotates in the reverse direction to align the sheet conveyed by the conveying roller, and then rotates in the forward direction for the sheet conveyance.

18. The sheet processing apparatus according to claim 17, wherein when the aligning roller stops rotation or rotates in the reverse direction to align the sheet conveyed by the conveying roller, the sheet conveyed by the conveying roller is warped towards the third stationary sheet guide, and when the aligning roller rotates in the forward direction for the sheet conveyance thereafter, the warped sheet is pushed by the movable sheet guide towards the second stationary sheet guide.

19. The sheet processing apparatus according to claim 16, further comprising:

a first stopper positioned to restrict movement of the movable sheet guide further than the first position; and a second stopper positioned to restrict movement of the movable sheet guide further than the second position.

20. The sheet processing apparatus according to claim 16, wherein the movable sheet guide is directly attached to a shaft of the aligning roller, and swings together with the shaft of the aligning roller rotating in the forward and reverse directions.

* * * * *